US007568475B2

(12) United States Patent
Lemke

(10) Patent No.: US 7,568,475 B2
(45) Date of Patent: Aug. 4, 2009

(54) OIL SEPARATOR ELEMENT

(75) Inventor: Kai-Uwe Lemke, Ulm (DE)

(73) Assignee: Reinz-Dichtungs-GmbH, Neu-Ulm (DE)

( * ) Notice: Subject to any disclaimer, the term of this patent is extended or adjusted under 35 U.S.C. 154(b) by 146 days.

(21) Appl. No.: 11/894,395

(22) Filed: Aug. 21, 2007

(65) Prior Publication Data

US 2008/0047505 A1 Feb. 28, 2008

(30) Foreign Application Priority Data

Aug. 22, 2006 (DE) ..... 10 2006 039 354

(51) Int. Cl.
*F01M 13/04* (2006.01)
*F02F 7/00* (2006.01)

(52) U.S. Cl. ..... 123/572

(58) Field of Classification Search ..... 123/572–574, 123/41.86; 55/326, 418, 421, 521
See application file for complete search history.

(56) References Cited

U.S. PATENT DOCUMENTS

| | | | | |
|---|---|---|---|---|
| 2,252,242 | A | 8/1941 | Wood | |
| 2,555,125 | A | 5/1951 | Gregory | |
| 3,431,899 | A * | 3/1969 | Neidhart | 123/572 |
| 4,565,164 | A | 1/1986 | Satoh et al. | |
| 5,323,745 | A | 6/1994 | Satoh et al. | |
| 6,860,915 | B2 * | 3/2005 | Stegmaier et al. | 123/572 |
| 2007/0281205 | A1 * | 12/2007 | Wagner et al. | 429/49 |

FOREIGN PATENT DOCUMENTS

| | | | |
|---|---|---|---|
| AT | 363916 | B | 9/1981 |
| DE | 10 2004 037 156 | A1 | 3/2006 |
| DE | 102004037157 | A1 | 3/2006 |
| JP | 6-193424 | A | 12/1994 |

* cited by examiner

*Primary Examiner*—Marguerite J. McMahon
(74) *Attorney, Agent, or Firm*—Marshall & Melhorn, LLC

(57) ABSTRACT

An oil separator element of the type that is used, for example, for the separation of oil from blow-by gases in internal combustion engines is disclosed.

The oil separator element has a housing which forms a cavity through which the gas can flow. The housing has an interface which divides the oil separator element into two element halves. Each of the element halves has a groove family in the interface. The grooves of the two families thereby run at an angle to one another in the interface and at least some of the grooves intersect one another.

In an oil separator element of this type, the air flowing through is set in rotational motion so that both on account of the centrifugal forces that occur as well as the impact of the oil mist or the oil droplets that are contained in the gas that is carrying the oil, these oil droplets or oil mist are separated on the walls of the grooves.

13 Claims, 7 Drawing Sheets

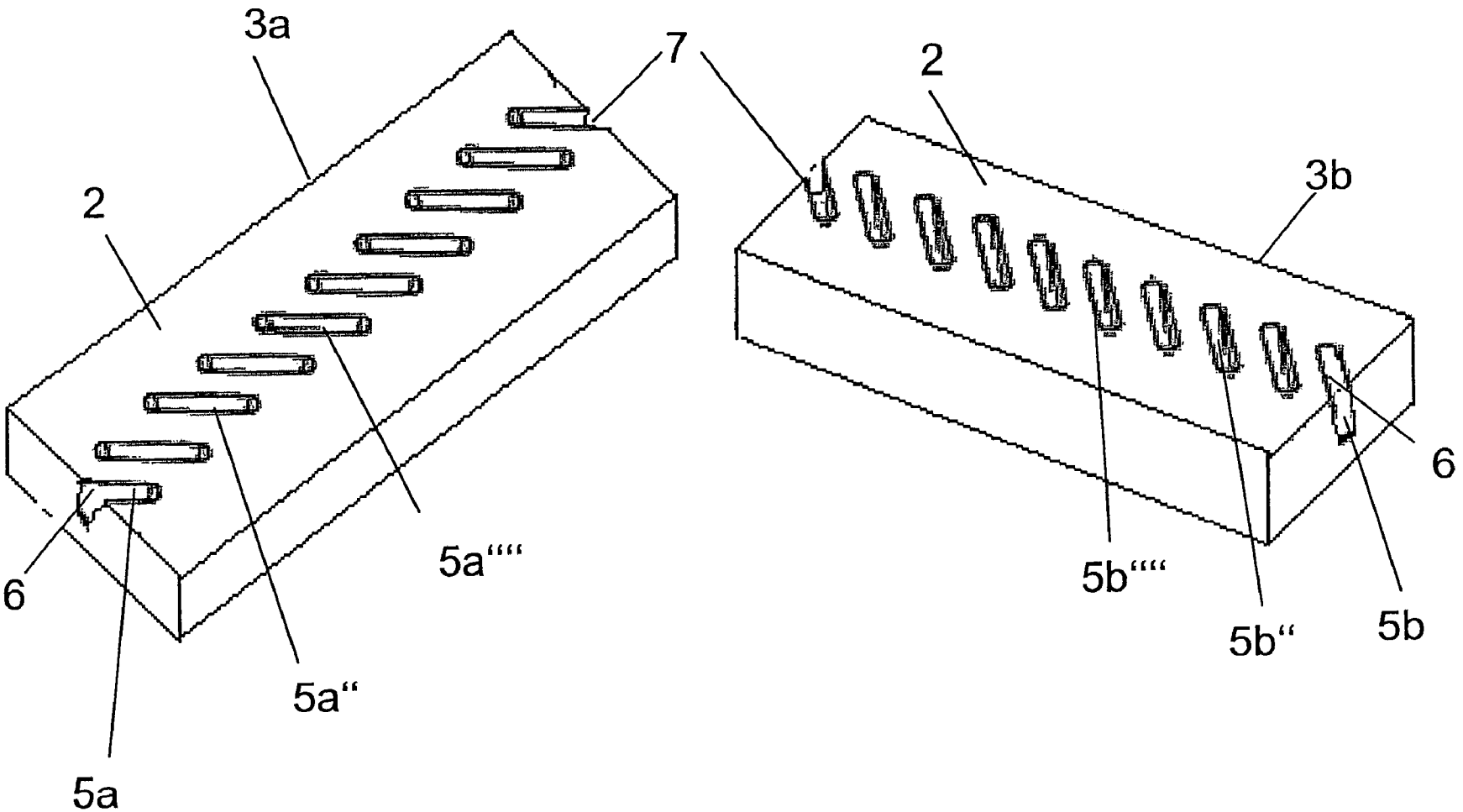
Figure 2-a

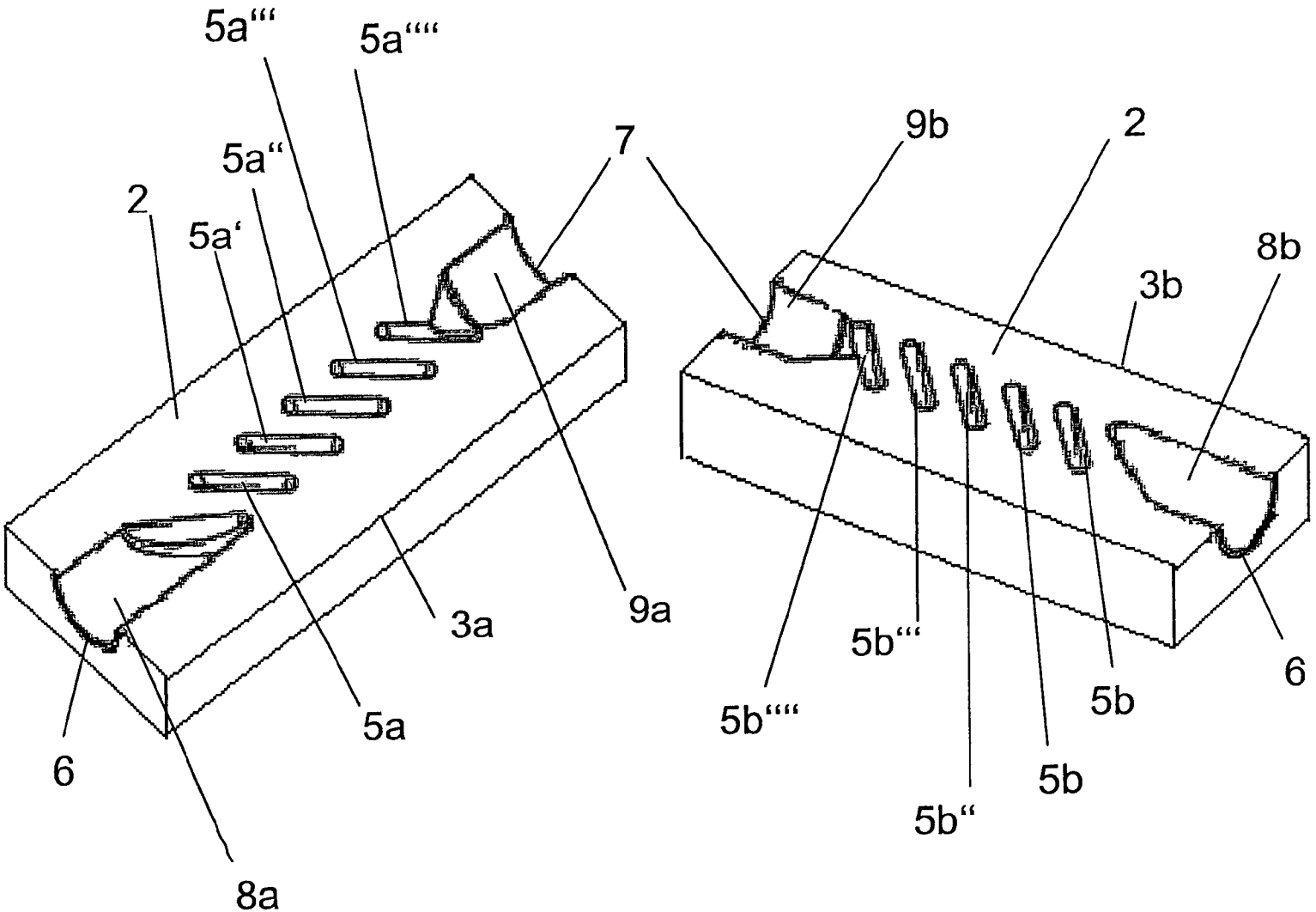
Figure 2-b

OIL SEPARATOR ELEMENT

RELATED APPLICATIONS

The present application claims priority from German patent application number DE 10 2006 039 354.6 filed on Aug. 6, 2006, which is incorporated by reference in its entirety.

FIELD OF THE INVENTION

This invention relates to an oil separator element, of the type, for example, that is used for the separation of oil from blow-by gases in internal combustion engines.

BACKGROUND OF THE INVENTION

Oil separator elements of this type are conventionally constructed in the form of cyclones, labyrinth separators, baffle plate separators or similar structures.

Cyclones in the shape of a helix or screw are frequently used as oil separator elements. These cyclones utilize the rotation of the gas to effect a separation of particles and droplets by centrifugal force. One disadvantage of these helixes or screws, however, is that they can be manufactured economically only when they are oriented in the direction in which a plastic component is removed from the mold. Therefore, the opportunities for the placement of an intake point of an oil separator of this type are very limited. In particular, a lateral intake, with respect to the direction in which the plastic component is removed from the mold, can be incorporated only with certain restrictions or with a great deal of effort and expense in terms of design and manufacture.

SUMMARY OF THE INVENTION

The object of the invention is therefore to make available an oil separator element that is subject to the fewest possible restrictions with respect to its placement, for example inside a cylinder head cover. An additional object of the invention is to make available a cylinder head cover that is provided with an oil separator element of this type.

The foregoing objects are accomplished by the method and apparatus claims herein. Advantageous developments of the oil separator element claimed by the invention and of the cylinder head cover claimed by the invention are described in the respective dependent claims.

The oil separator element claimed by the invention is an integral component of a housing and forms a cavity through which the gas can flow. The oil or the oil droplets are separated in this cavity. This cavity has at least two openings on the housing, i.e. at least one in the form of an inlet for gas, gas carrying oil and oil mist, and one in the form of an outlet for gas and the oil that has been separated from it. This cavity can also carry the flow of gas such as blow-by gases, for example, between the inlet and outlet. The inlet and outlet are at some distance from each other. The inlet is conventionally located on the outside of the housing and the outlet on the inside. The housing has at least one additional outlet.

The invention teaches that the housing has an interface which divides the housing and the at least one oil separator element located in it into two separable housing elements or oil separator element halves. The term "oil separator element half" is thereby intended to be understood to mean that the two halves of the oil separator element are complementary to each other when they are combined to form an oil separator element, although the halves need not necessarily each form 50% of the total oil separator element. On the contrary, the proportions of the oil separator element that are represented by each half can be quite different from 50%.

The invention teaches that in each of the interfaces of the two halves of an oil separator element there is a family of grooves that run with respect to their longitudinal direction in the interface, i.e. parallel to the interface. They are therefore open toward the top with reference to the interface. The grooves of the two families are thereby oriented so that they run at a defined angle to one another in the interface and intersect one another. At least one groove of each family does not extend from the inlet to the outlet. Each family forms one half of the oil separator element.

The interfaces of the oil separator element halves are thereby advantageously realized in the form of a sealing element between neighboring grooves outside the intersection points, i.e. the interfaces are configured so that outside the grooves and optionally the inlets and outlets, the interfaces of the oil separator elements jointly form seal lines or sealing contact surfaces. The interfaces are advantageously in contact with each other where their grooves and outlets or inlets do not intersect or overlap.

In an oil separator element of this type the gas flows from the inlet into the cavity of intersecting grooves formed by the two families which combine to form a grid. The gas then flows along a groove and from there, at the final point of intersection with a groove of a neighboring family, into this groove of the neighboring family. The gas then flows along the neighboring groove and then, at the last point of intersection of this groove with an additional groove of the original family, overflows into this groove. Alternately, when the gas reaches the outlet, it exits the separator element. The transition is then guaranteed only if at least one groove of each family does not extend from the inlet to the outlet. Overall, this arrangement results in a torsional motion or a twisting motion of the flowing gas, because the gas is constantly changing back and forth from one flow direction to the other. On account of the centrifugal forces that occur, when oil droplets impact the wall of the groove they are separated from the gas that is carrying the oil or the oil mist.

While a common inlet and/or common outlet can be provided for both halves of the separator element, separate inlets or a plurality of inlets and/or outlets can also be provided.

Inlets and outlets can be located in any position of the groove family. That means that the gas enters (or exits) both groove families simultaneously if both grooves are present at the intersection of the groove family with the outside edge of both grooves. Alternatively, the groove families can be oriented relative to the outer edge so that only one groove is present at the intersection. In that case, the gas is distributed to both groove families at a point of intersection.

One advantage of the oil separator element claimed by the invention is that it is scalable, because any desired number of such oil separator elements can be located next to one another or any desired number of grooves can be located in each groove family. The number, length and/or width of grooves can thereby also vary among the individual oil separator elements or between the halves of oil separator elements.

The cylinder head cover claimed by the invention is provided with an oil separator element of the type described above. Because cylinder head covers conventionally have an upper shell and a lower shell in any case (valve hood and baffle/wash plate), the oil separator element halves of the at least one oil separator element claimed by the invention can be introduced into the element halves as early as during the shaping of the upper and lower housings. The plane of separation thereby corresponds to the contact surface between the upper housing and the lower housing and thus also the plane of separation between the halves of the oil separator element; the grooves are oriented in the direction in which the top and bottom housings are removed from the mold. This arrangement makes possible an extremely economical fabrication of cylinder head covers with oil separation. In particular, no additional parts are necessary for the realization of the rotation separator.

It is particularly advantageous if the grooves of the two families run at an angle of 60° to 120° to one another, preferably 80° to 100° and in particular at an angle of 90° to one another. The grooves of the families can also advantageously run at a defined angle to the average flow-through direction of the oil separator element, whereby the average flow-through direction is defined as the direction that results from the gas flow direction averaged over one rotation through the grooves.

With regard to the length and width of the grooves, any desired ratios can be established. It is particularly advantageous, however, if the width and length of the grooves are in a ratio between 1:10 to 1:3, preferably 1:5.5 to 1:4.5, and particularly advantageously 1:5. The width of the grooves is therefore a direct function of the wall thickness of the top and bottom housings in the vicinity of the interface.

However, both the direction of the grooves, their cross section shape, their width and also the depth of the grooves in the longitudinal direction can vary. In particular, it is not necessary for the grooves in the respective interface to run in a straight line. The grooves can also be curved.

Because the oil separator element or the plurality of oil separator elements can be installed in the interface between the top housing and the bottom housing of a cylinder head cover without any additional space requirement, it is particularly advantageous that this oil separator element can be used as a pre-separator for a prior art oil separator already installed on the cylinder head cover or in the interior of the cylinder head cover.

Cylinder head covers and the top and bottom housings that form them are conventionally manufactured by means of injection molding from thermosetting plastics or thermoplastics. Thermoplastic materials are thereby preferred. For the manufacture of the cylinder head cover claimed by the invention, the molding die is therefore configured so that in the direction in which the part is ejected from the mold, at the interface between the two halves of the housing, there are generally a plurality of flashings that are oriented parallel to one another or run diagonally with respect to the outside or inside wall of the half-housings. The individual flashings have a greater depth toward their middle than on their ends. During the injection molding of the respective half-housings, the groove families that form the oil separator element halves of the oil separator element claimed by the invention are realized in the half-housings by means of these flashings. The groove families are thereby located in the form of a depression in the halves of the oil separator element in the direction in which the oil separator element halves are removed from the mold.

Several examples of the oil separator element and cylinder head cover claimed by the invention are explained in greater detail below. Elements that are identical or similar in all the figures are thereby identified with identical or similar reference numbers. This description of the invention and of the accompanying figures must not be interpreted to mean that the simultaneous presence of all of the features of the individual embodiments is essential to the invention, but that individual aspects of the exemplary embodiments are also to be considered individually as belonging to the invention.

BRIEF DESCRIPTION OF THE FIGURES

FIG. 2 partial FIGS. 2-*a* and 2-*b* illustrate respective variants of an oil separator element claimed by the invention;

DETAILED DESCRIPTION OF THE PREFERRED EMBODIMENTS

Figure 1:
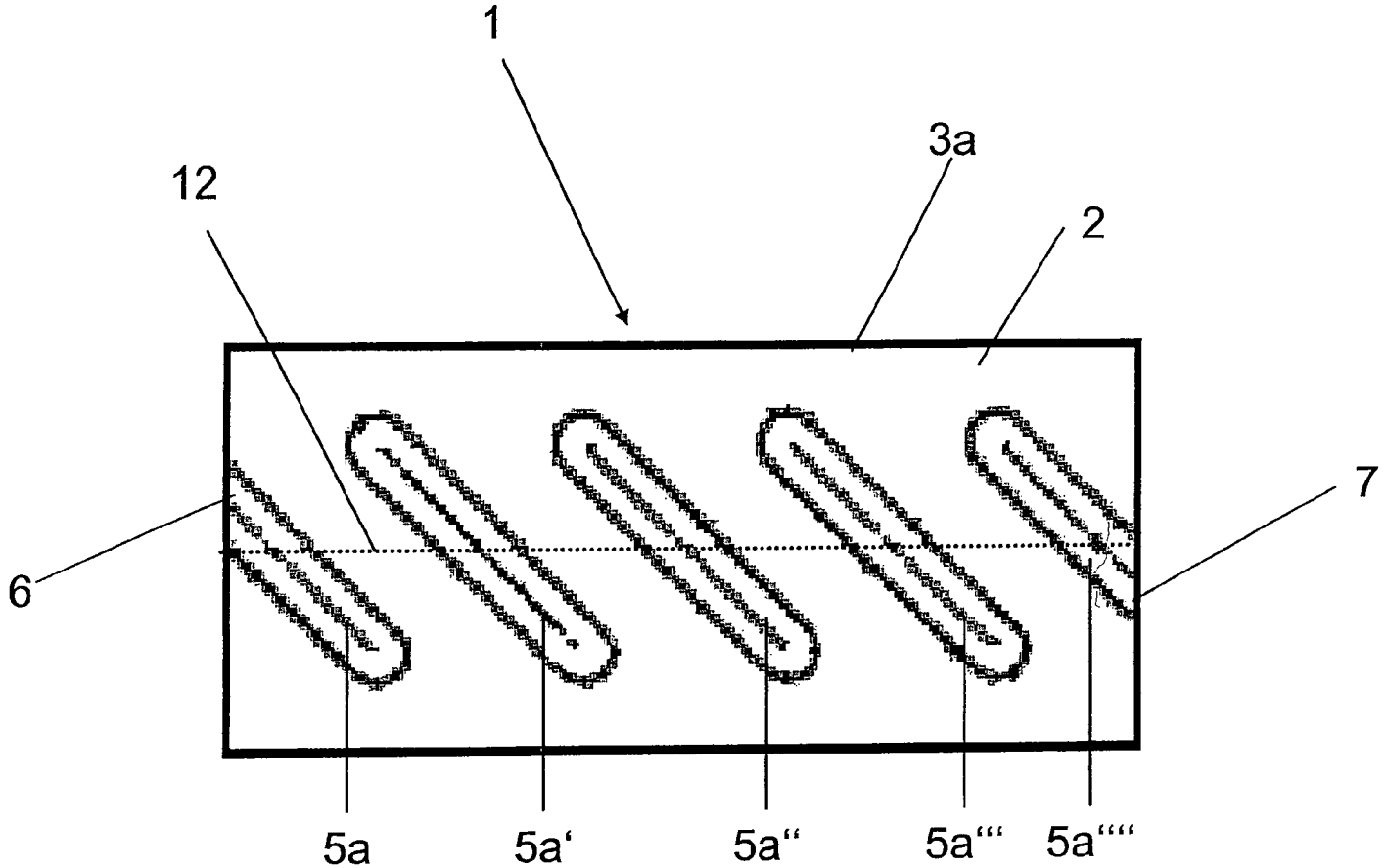
FIG. 1 is a detail of one half of an oil separator element of an oil separator element claimed by the invention.

FIG. 1 shows a view of the interface 2 of an oil separator element half 3*a*. This oil separator element half 3*a*, with its grooves 5*a* to 5*a*"", spans the shape of half of a cylindrical element that is cut through in the longitudinal direction. The overall oil separator corresponds to two such semi-cylindrical parts which are placed next to each other along their interface. An oil separator element that is formed from such oil separator elements halves can be a component of a cylinder head cover. A plurality of such oil separator elements can also be integrated into the cylinder head cover.

Conventionally, the illustrated interface 2 is part of a larger interface. For example the interface of the upper half-housing 3*a* can be part of the valve cover and a corresponding lower bottom housing 3*b* can be part of the wash plate of a cylinder head cover.

The interface 2 has a family of grooves 5*a* to 5*a*"" which all run parallel to one another with reference to their longitudinal direction in the interface 2. In this example, these grooves are oriented at an inclination of 45° with respect to the longitudinal direction 12 and thus also the average flow-through direction of a gas in the oil separator. On the one end surface of the oil separator element half 3*a*, the groove 5*a* forms an inlet 6 and on the other end surface of the oil separator element half 3*a*, the groove 5*a*"" forms an outlet 7. The gas then flows through the inlet 6 into the groove 5*a*, from where it overflows into the oil separator element half 3*b* (not shown) and subsequently alternates back and forth between the grooves in the interface 2 of the oil separator element half 3*a* and the grooves in the interface of the other neighboring oil separator half and finally reaches the outlet 7. The oil that is separated from the gas as it travels through the oil separator element as a result of impacts against the wall of a groove can also be discharged from the groove family at the outlet 7.

FIG. 2-*a* shows two oil separator element halves 3*a* and 3*b* of an oil separator element claimed by the invention. The two oil separator element halves are in and of themselves constructed identically, although in the assembled oil separator element they are located facing each other and rotated 180°. The oil separator element halves 3*a* and 3*b* are constructed as illustrated in the detail from the oil separator element half 3*a* in FIG. 1.

FIG. 2-*b* shows an additional design of the oil separator element halves 3*a* and 3*b* of an oil separator element. Theoretically, each of the oil separator element halves 3*a* and 3*b* is constructed identical to the oil separator element halves 3*a* and 3*b* illustrated in FIG. 2-*a*. The decisive difference in this case is that in FIG. 2-*b*, the oil separator element halves 3*a* and 3*b* have expanded inlet areas 8*a*, 8*b*, via which the gas can flow into the oil separator element halves. Expanded outlet areas 9*a* and 9*b* are provided in a similar manner. The expanded areas 8*a*, 8*b*, 9*a*, 9*b* thereby do not necessarily have to be configured identically.

The housing elements illustrated in FIGS. 2-*a* and 2-*b* that contain the oil separator element halves 3*a* and 3*b* are conventionally not separate housings. Normally, the housing halves that are shown here with a rectangular cross section are an integral component of a larger housing, such as e.g. valve covers and wash plates of cylinder head covers. In that case, the accompanying illustrations are details of the larger housings described above.

Figure 3:
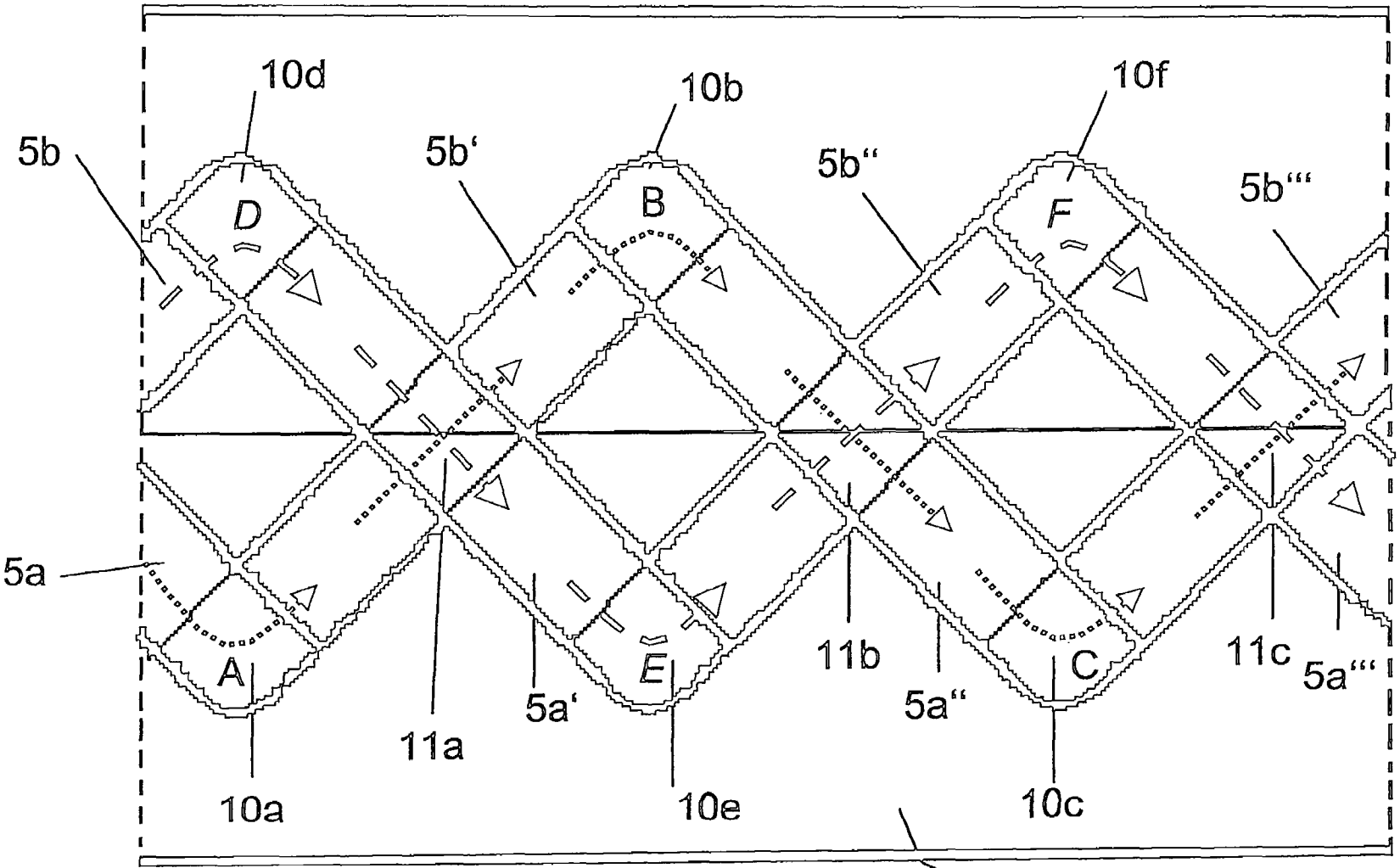
FIG. 3 is a view through two oil separator element halves combined to form the oil separator element claimed by the invention.

FIG. 3 shows a phantom view through two oil separator element halves joined together into one oil separator element. Both the grooves in the lower oil separator element half and the grooves in the upper oil separator element half are thereby clearly visible. The grooves of the one oil separator element half run from the top left toward the lower right (grooves 5*a*, 5*a*', 5*a*", 5*a*'") and the grooves of the other oil separator element half run from the bottom left toward the top right (grooves 5*b*, 5*b*', 5*b*", 5""). In the plane of the section, there are therefore points of intersection between the grooves of these two groove families, in particular points of transition at the ends of the respective grooves (points of intersection or transition 10*a*-10*f*).

If we now follow the gas current that flows through the groove 5*a*, the path of the gas current is indicated by the arrows A, B and C. The gas thereby alternates at the transition point 10*a* from the groove 5*a* into the groove 5*b*', at the transition point 10*b* from the groove 5*b*' into the groove 5*a*" and at the transition point 10*c* from the groove 5*a*" into the grove 5*b*'". Every time it alternates from one groove into the other, not only does the direction of the gas flow in the plane of the interface 2 change, the gas also alternates back and forth between the two oil separator element halves (3*a* and 3*b* in FIG. 2). The overall effect is to create a rotational movement of the gas.

It is therefore essential that at each of the terminal points of intersection 10*a* to 10*f*, the gas alternates from one groove in one oil separator element half into the neighboring groove in the neighboring oil separator element half. At the non-terminal points of intersection 11*a*, 11*b*, 11*c*, however, no significant exchange of the gas between the two oil separator element halves takes place, because the same pressure conditions prevail in both gas currents and in both of the intersecting grooves.

Figure 4:
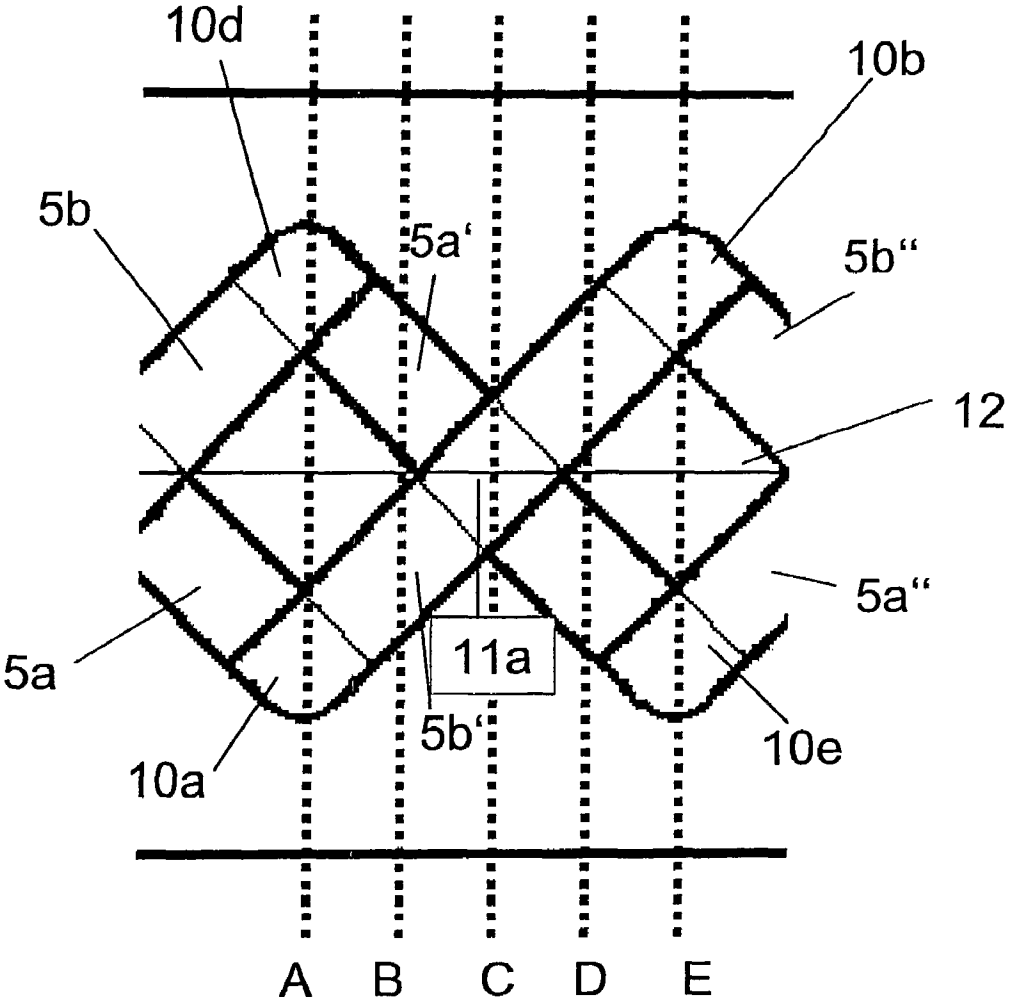
FIG. 4 is a detail from the phantom view in FIG. 3.

FIG. 4 shows a detail from FIG. 3, whereby this figure also shows sectional planes A, B, C, D and E.

Figure 5:
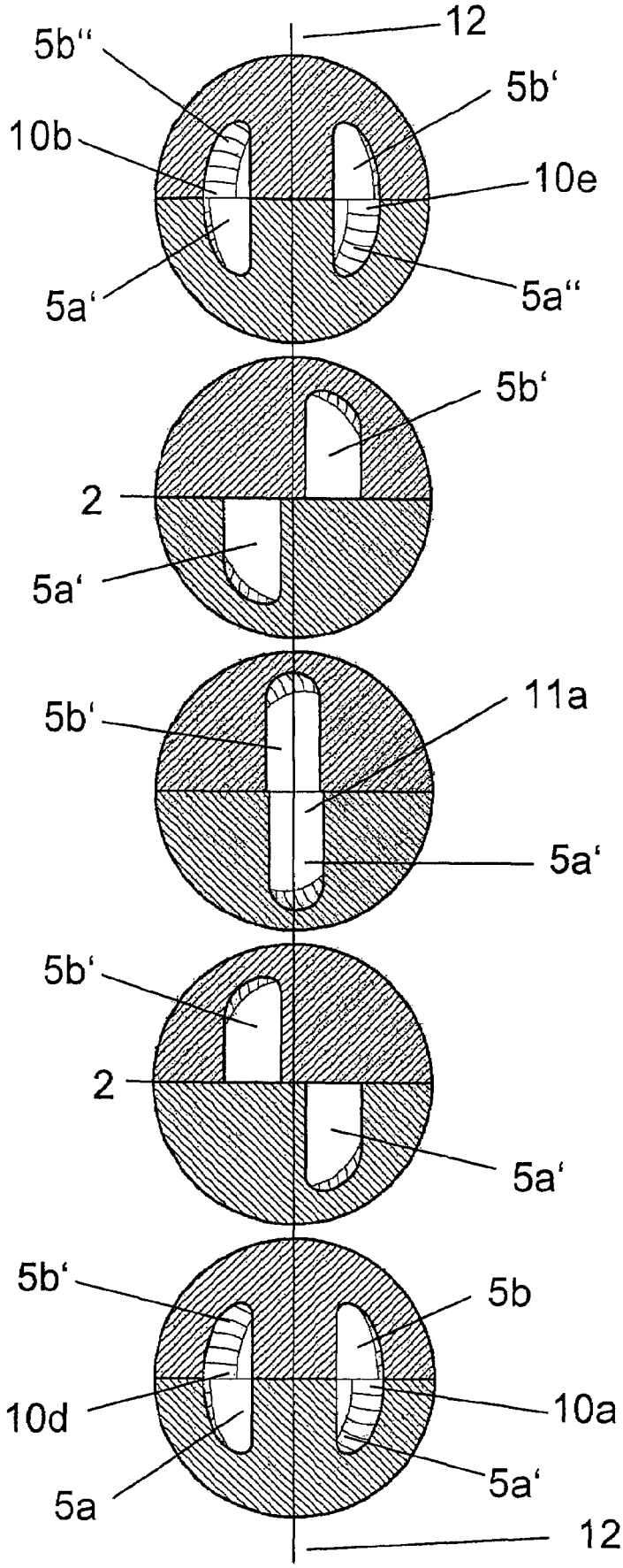
FIG. 5 are sectional views perpendicularly through the oil separator element in FIGS. 3 and 4.

FIG. 5 shows, in the sub-FIGS. 5-*a* to 5-*e*, sectional views perpendicular to the axis 12 (sectional planes perpendicular to the longitudinal dimension of the oil separator element), corresponding to the sectional planes indicated in FIG. 4. A cylindrical detail of a larger housing is shown here by way of example. FIG. 5-*a* thereby corresponds to the section in the plane A, 5-*b* in the plane B, 5-*c* in the plane C, 5-*d* in the plane D and 5-*e* to the section in the plane E in FIG. 4. It is apparent that there are transition zones only in the planes A, C and E, whereby on account of the dynamic conditions of the flow, an overflow of the gas between neighboring grooves occurs only at the terminal intersection points 10*a*, 10*d*, 10*e*, 10*b*, but not at the non-terminal intersection point 11*a*. The rotating forward movement of the two gas flows can be observed in the sequence of the cross sections 5-*a* to 5-*e*.

Section 5-1 shows the two terminal intersection points 10*a* and 10*d*. The gas flow in the groove 5*a* overflows at its end (or shortly before its end) into the neighboring groove 5*b*', and likewise the gas flow in groove 5*b* into its neighboring groove 5*a*'. In section 5-*b*, the two gas streams flow toward the axis 12. In comparison to section 5-*a* the groove depth of both grooves 5*a*', 5*b*' has increased. The two grooves 5*a* and 5*b* are already terminated in section 5-*b*.

Section 5-*c* illustrates the non-terminal intersection point 11*a* at which the grooves 5*a*', 5*b*' have reached their maximum depth and intersect the axis 12. Only in the boundary area of the two gas flows can the gas flow from one family of grooves to another. The gas flows primarily follow their forward-directed rotational movement.

In Section 5-*d*, the two gas flows are moving away from the axis 12. In comparison to section 5-*c*, the groove depth of both grooves 5*a*', 5*b*' has decreased again. Section 5-*e* illustrates the two terminal intersection points 10*b* and 10*e*. Here, the gas flow from groove 5*a*' overflows into the groove 5*b*", and the gas flow in groove 5*b*' into the groove 5*a*".

The two gas flows, on their path between the terminal intersection points (10*a* and 10*b* and 10*d* and 10*e* respectively) have each completed 180° of their forward directed rotational movement.

Figure 6:
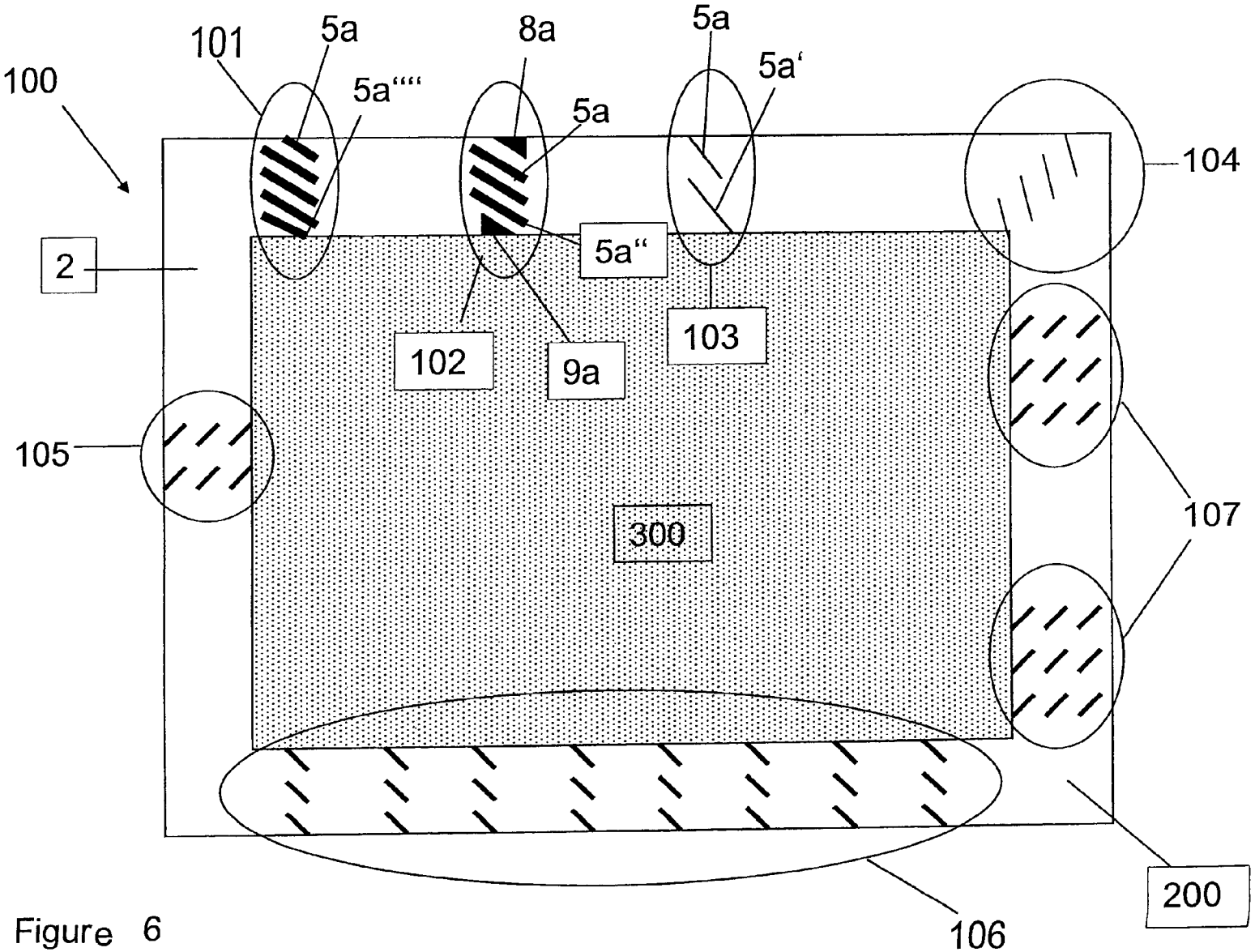
FIG. 6 is a schematic view of a top and bottom housing of a cylinder head cover claimed by the invention.

FIG. 6 shows schematically a plan view of a top or bottom housing 100 of a cylinder head cover claimed by the invention, conventionally a valve hood or a wash plate. Thereby only the peripheral area that forms an encircling wall 200, which in this case is drawn larger than actual size for purposes of explanation, is relevant to the invention. For this reason, none of the details of the inner area 300 are shown, nor the outlet that must be present in the cylinder head cover. The groove families or groups of groove families 101 to 107 show by way of example orientations of oil separator element halves in the interface 2 of the wall 200. All the grooves or groups of grooves 101 to 107 are arranged so that a flow from outside the housing into the inner area 300 is possible.

The groove family 101 thereby has five relatively wide grooves 5*a* to 5*a*"". Groove family 102 likewise includes three relatively wide grooves 5*a* to 5*a*" between an expanded inlet area 8*a* and an expanded outlet area 9*a*. Groove family 103 consists only of two narrow grooves 5*a* and 5*a*'; for the functioning of an oil separator element, it would be sufficient if the oil separator element half formed from groove family 103 were combined with an oil separator element half with only one groove 5*b* connecting the two grooves 5*a* and 5*a*'.

The groove family 104 demonstrates the theoretical possibility of also realizing the oil separator element claimed by the invention in the corner area of the wall 200 of the top or bottom housing of a cylinder head cover claimed by the invention.

The groups of groove families 105 to 107 illustrate additional location possibilities along the periphery of the interface of the wall 200, either in the form of a small group 105 on one or a plurality of sides (not shown), in the form of a plurality of groups 106 on one or a plurality of sides (not shown) or even in the form of a grid-shaped arrangement 107 on one or a plurality of sides (not shown). Generally, preference is given to a large number of groove families. The respective location and arrangement will be determined on the basis of the specific application.

What is claimed is:

1. An oil separator element, comprising: a housing that forms a cavity through which gas can flow and which has, on its two ends, openings for the inlet and/or outlet of a gas, wherein the housing has an interface that divides the oil separator element into two oil separator element halves, and that in the interface of each of the two oil separator element halves there is a family of grooves which extend in their longitudinal direction parallel to the interface and in the interface, and form a part of the cavity through which the gas can flow, and the grooves of the one family run at an angle in the interface to the grooves of the other family, and at least some of the grooves intersect with the latter.

2. The oil separator element of claim 1, wherein the grooves of the one family run at an angle between 60° and 120° to the grooves of the other family.

3. The oil separator element of claim 2, wherein the groove of the one family run at an angle between 80° and 100° to the grooves of the other family.

4. The oil separator element of claim 3, wherein the groove of the one family run at an angle of 90° to the grooves of the other family.

5. The oil separator element of claim 4, wherein the grooves run at a defined angle with respect to the average flow direction of the oil separator element.

6. The oil separator element of claim 5, wherein the grooves run at an angle between 5° and 85° to the average flow direction.

7. The oil separator element of claim 6, wherein the grooves run at an angle between 35° and 55° to the average flow direction.

8. The oil separator element of claim 7, wherein the grooves run at an angle of 45° to the average flow direction.

9. The oil separator element of claim 8, wherein the width of the grooves and the length of the grooves are in a ratio between 1:10 to 1:3.

10. The oil separator element of claim 9, wherein the width of the grooves and the length of the grooves are in a ratio between 1:5.5 and 1:4.5.

11. The oil separator element of claim 10, wherein the width of the grooves and the length of the grooves are in a ratio of 1:5.

12. The oil separator element of claim 11, wherein the direction, the cross section shape, the width and/or the depth of the grooves varies in the longitudinal direction of the grooves.

13. The oil separator element of claim 12, wherein the interface is flat.

* * * * *